United States Patent [19]

Kirkland, Jr.

[11] 4,099,047

[45] Jul. 4, 1978

[54] COMMODE VENTILATION SYSTEM

[76] Inventor: James R. Kirkland, Jr., 8703 Magnetic St., El Paso, Tex. 79904

[21] Appl. No.: 743,408

[22] Filed: Nov. 19, 1976

[51] Int. Cl.[2] ..... H05B 1/00; F24H 3/04

[52] U.S. Cl. ..... 219/370; 4/213; 98/43 A; 219/368; 219/374

[58] Field of Search ..... 4/72, 83, 96, 209, 118, 4/131, 213, 216, 217, 221, 162; 219/374, 370, 369, 366, 360, 368; 98/43 A

[56] References Cited

U.S. PATENT DOCUMENTS

| | | | |
|---|---|---|---|
| 1,922,798 | 8/1933 | Frech et al. | 4/162 |
| 2,009,054 | 7/1935 | Mooney | 4/213 |
| 2,023,127 | 12/1935 | Fairchild | 4/213 |
| 2,309,885 | 2/1943 | Carman | 4/213 |
| 2,459,986 | 1/1949 | Worden | 219/368 |
| 2,846,696 | 8/1958 | Herriott | 4/213 |
| 3,059,244 | 10/1962 | Jarrett | 4/213 |
| 3,418,452 | 12/1968 | Grabner | 219/366 X |
| 3,763,505 | 10/1973 | Zimmerman | 4/213 |
| 3,857,119 | 12/1974 | Hunnicutt, Jr. | 4/213 |
| 3,869,737 | 3/1975 | Stevenson | 4/213 |

*Primary Examiner*—Thomas J. Kozma

[57] ABSTRACT

A commode ventilation systems including a housing mounted from the upper edge of the commode bowl by a clamping mechanism and provided with an air circulating fan having an intake communicated with the interior of the commode bowl and a discharge communicated with ambient air in the bathroom. A heating element, such as an electrical resistance type heating element, is disposed in the housing and in the flow path so that odors entrained in the air circulating through the housing will be neutralized so that deodorized and purified air will be discharged into the bathroom.

2 Claims, 7 Drawing Figures

20
82
128
132
132
130
36
30
10
32
12
22
76
26
28
24
18
16
14

81
82
10
34
84
88
92
90
122
38
124
116
40
30
32
28
76
26

106
84
108
86
102
36

Fig. 3
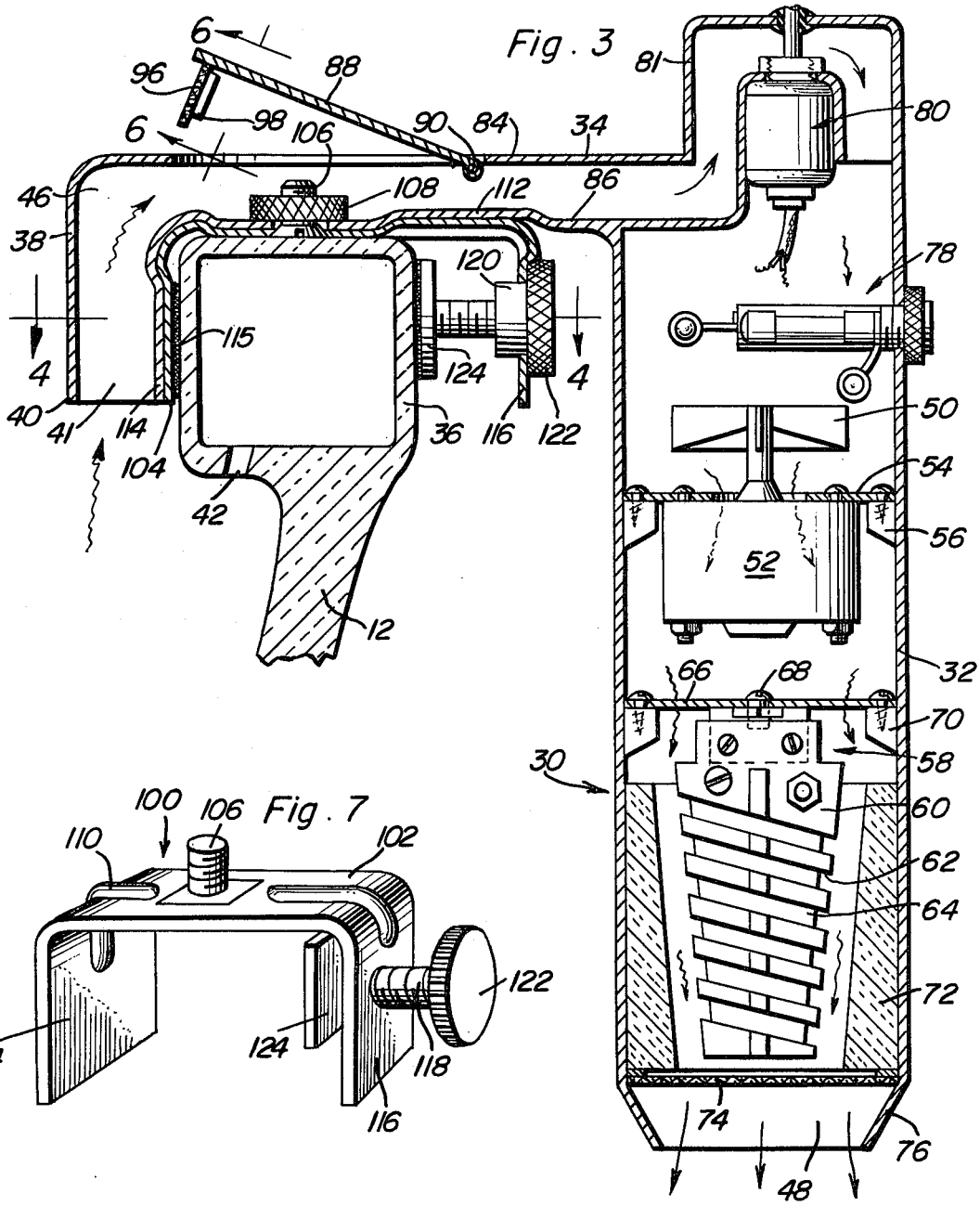
Fig. 7
Fig. 4
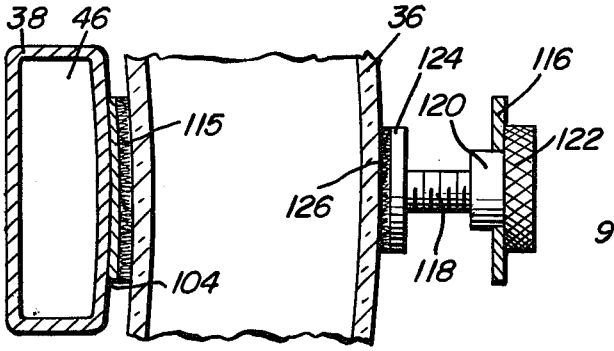
Fig. 6
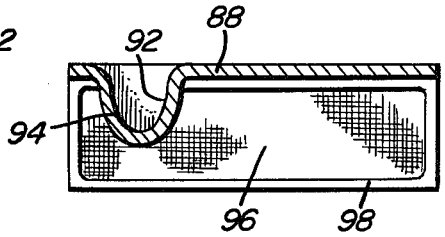

COMMODE VENTILATION SYSTEM

BACKGROUND OF THE INVENTION

1. Field of the Invention

The present invention generally relates to a commode ventilation system for installation on a commode bowl which includes a housing having a portion extending interiorly of the bowl for air intake, together with a heating element in the housing for heating the air and neutralizing odors therein for discharging purified and deodorized air into the bathroom.

2. Description of the Prior Art

Previously patented devices for ventilating commode bowls, and the like, usually have included a discharge communicated with a vent stack or pipe for discharge of air with odors entrained therein to the outside atmosphere or to an area remote from the bathroom, so that the objectionable odors will be removed from the commode bowl. Such devices are usually rather cumbersome, unsightly and frequently require modification of the bathroom wall structure or special attachment facilities for supporting the device in association with the commode. Examplary developments in this field of endeavor are disclosed in the following U.S. Pat. Nos.: 2,100,962 — Nov. 30, 1937, 2,326,957 — Aug. 17, 1943, 2,747,201 — May 29, 1958, 2,846,696 — Aug. 12, 1958, 3,059,244 — Oct. 23, 1962.

SUMMARY OF THE INVENTION

An object of the present invention is to provide a commode ventilation system in which air with odors entrained therein are removed from the interior of the commode bowl and passed through a neutralizing and purifying assembly and discharged directly into the ambient air within the bathroom in which the neutralizing and purifying assembly includes a heating element which will elevate the temperature of the air and odor producing gases entrained therein to a temperature level which will neutralize, deodorize and purify the air so that when the air is discharged into the bathroom, it will not have objectionable odors entrained therein.

Another object of the invention is to provide a commode ventilation system in accordance with the preceding object in which a housing is provided for mounting from the upper edge of a commode bowl by utilizing a manually operated clamp mechanism that enables the housing to be associated with various types of standard sized commode bowls and enables the housing to be securely clamped in position with the housing including an inner end portion disposed interiorly of the commode bowl at the upper edge thereof, an intermediate portion overlying the upper edge of the commode bowl and underlying the commode seat and an inner portion disposed along the external surface of the commode bowl below the upper edge thereof, with the outer portion including a circulating fan and electric heating element of the resistance type.

A further object of the invention is to provide a commode ventilation system in accordance with the preceding objects in which the circulating fan is provided with an intake passageway extending through the intermediate portion and inner portion of the housing with a filtering or screening device being provided in the passageway to prevent entry of lint, paper, or the like, and the intermediate portion of the housing includes a pivotal plate enabling access to the filtering or screening device and the structure for assembling the clamp device to the housing.

Still another object of the invention is to provide a commode ventilation system in accordance with the preceding objects in which the outer portion of the housing includes a timer to automatically cut off power to the circulating fan and resistance heating element after a predetermined time, so that the ventilation system will not operate continuously after it has been started by closing a switch in an electrical supply circuit.

Another important feature of the present invention is to provide a commode ventilation system which is easy to install, effective for neutralizing odors and purifying the air for discharge into the bathroom, dependable and long lasting in operation, and completely safe in operation since an upwardly offset area in the flow path prevents flow of water to the electrical components even if the commode bowl accidentally overflows due to blockage, or the like.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a vertical, sectional view taken generally along the center of the ventilator illustrating the structural details thereof.

FIG. 4 is a plan sectional view taken substantially upon a plane passing along section line 4—4 of FIG. 3 illustrating further structural details of the clamp mechanism and its association with the commode bowl and inner portion of the ventilator.

FIG. 6 is a detailed, sectional view taken generally upon a plane passing along section line 6—6 of FIG. 3 illustrating further structural details of the filtering member.

FIG. 7 is a perspective view of the clamp for securing the ventilator to the commode bowl.

DESCRIPTION OF THE PREFERRED EMBODIMENT

Figure 1:
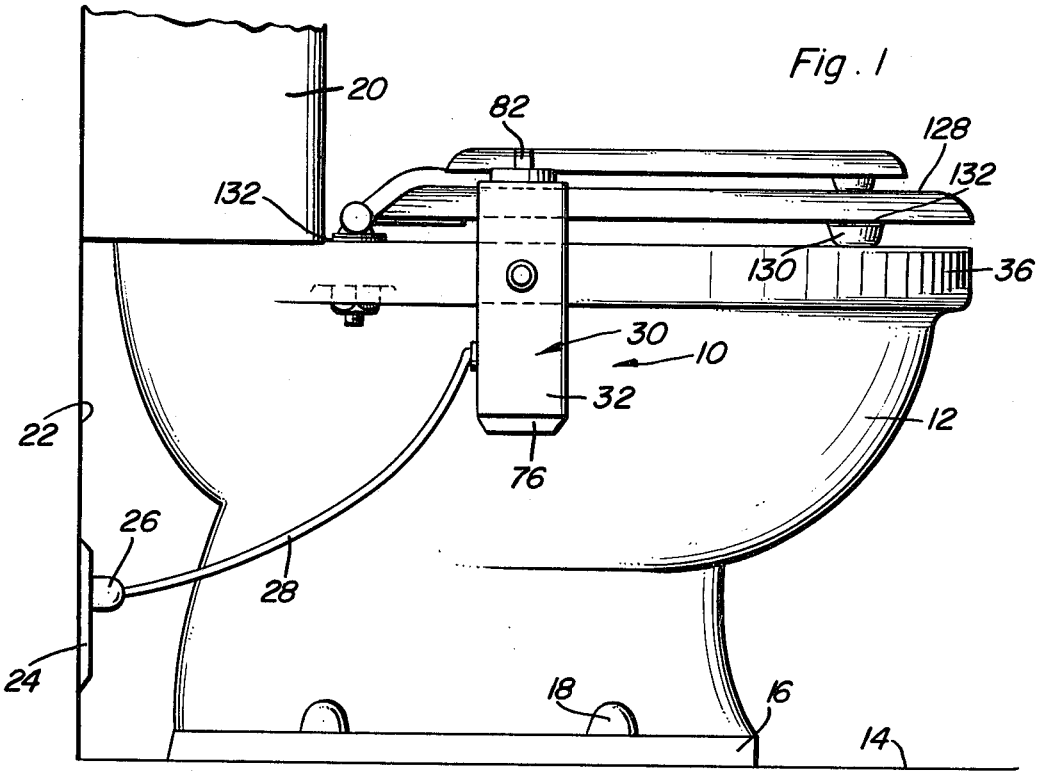
FIG. 1 is a side elevational view of a commode illustrating the commode ventilator and deodorizer installed thereon and connected to a conventional electrical outlet.

Referring now specifically to the drawings, the commode ventilation system is illustrated in association with a conventional bathroom commode and includes a ventilator generally designated by the numeral 10 associated with a commode bowl 12 supported from the bathroom floor 14 by the usual base 16 and anchoring devices 18. A water tank 20 is disposed in overlying relation to the rear portion of the bowl 12 with the tank 20 being supported from the wall 22 in a conventional manner or the tank may be the type supported solely from the commode bowl. Also, a standard female socket or electrical outlet 24 is provided in the wall 22 at a convenient location to enable electrical energy to be supplied to the ventilator through a male plug 26 and a supply cord 28 of conventional construction.

The ventilator 10 includes a housing generally designated by numeral 30 constructed of plastic or other suitable material and which includes a vertically disposed outer portion 32 disposed alongside of the external surface of the upper portion of the commode bowl 12 as illustrated in FIGS. 1 and 3. A horizontally disposed intermediate portion 34 extends from the upper end of the outer portion 32 and is relatively shallow in vertical heighth and extends across the upper surface of the top lip or rim 36 on the commode bowl 12. The inner end of the intermediate portion of the housing includes a downwardly extending inner portion 38 which is disposed alongside of the top lip or rim 36 as illustrated in FIG. 3 with the terminal lower end 40 of the inner portion terminating above the lower edge of the top lip or rim 36 so that the water passing downwardly through the openings 42 in the inner lower edge of the rim 36 will not be entrained in air passing into the passageway 46 which extends from the terminal lower end 40 of the inner portion 38 of the housing through the intermediate portion 34 and the outer portion 32 of the housing for discharge through a discharge opening 48 at the bottom of the outer portion 32. Thus, the air and odors within the commode bowl 12 pass through the passageway 46 from the inlet opening 41 defined by the terminal lower end 40 of the inner portion 38 to the discharge opening 48 from where they are dispersed throughout the room but the objectionable odors have been neutralized, deodorized and purified prior to their discharge.

For circulating the air and gases through the ventilator 10, an axial flow fan 50 is mounted adjacent the upper end of the vertical outer portion 32 of the housing 30. The fan 50 is driven by an electric motor 52 supported by a supporting plate 54 from embossments or an annular ring 56 formed integrally with the vertical outer portion 32 of the housing 30. The supporting plate 54 and fan motor housing 52 are constructed with suitable passageways to enable flow of air and gases downwardly in the vertical outer portion 32 of the housing 30. Disposed below the fan 50 and motor 52 is a heating element generally designated by numeral 58 which includes a vertically disposed insulating member 60 having radial blades provided with notches 62 receiving a resistance wire 64. The upper end of the insulating member 60 is supported from a perforated support plate 66 by an attaching member 68 so that the insulating member 60 and the resistance wire 64 mounted thereon will be suspended from the plate 66 which is supported from inwardly projecting lugs or supporting elements 70 on the vertical portion 32 of the housing 30. The insulating member 60 includes four vertical blades which taper downwardly and inwardly and represents a conventional electric heating resistance element with the resistance electric wire 64 being a 1200 to 1500 watt tungsten wire, or the like. The heating element is correlated with the fan or impeller 50 so that the volume of air moved over the heating coil will maintain a predetermined high temperature of the coil, between 425° F and 475° F, and prevent overheating. An insulating liner 72 of asbestos, or the like, is provided in the interior of the outer portion 32 of the housing 30 in enclosing relation to the heating coil 58 with the interior thereof generally tapering inwardly and downwardly in parallel relation to the heating coil to define an air passageway and protect the housing from the heat of the heating coil. A protective closure screen 74 is provided across the bottom end of the liner 72 to prevent physical contact with the heating coil. The lower end of the outer portion 32 of the housing 30 is inwardly inclined as at 76 for retaining the screen in place and to downwardly direct the air being discharged through the discharge opening 48.

The electrical cord 28 is connected to the fan motor and burning coil through a fuse assembly 78 and a timer 80, both of which are substantially conventional components in and of themselves. The timer 80 is supported in an upwardly offset portion 81 of the intermediate portion of the housing which will prevent water from reaching the electrical components even if the commode overflows due to blockage or for any other reason, thus eliminating danger of shock. The fuse may conveniently be a 30 amp fuse to protect the electrical circuit and the timer 80 includes a manually set indicator knob 82 by which a predetermined time period may be set, for example, 5 minutes, so that at the end of the time cycle, the ventilator 10 will be deenergized automatically.

The intermediate portion 34 includes a generally flat top wall 84 and a bottom wall 86 parallel thereto with the top wall 84 including a pivotal access door 88 pivoted at its outer edge by a hinge structure 90. The inner edge portion of the door 88 is provided with a finger receiving recess 92 by which the door may be opened with the finger recess 92 being defined by a continuous, imperforate depression 94 formed in the door 88. Connected to the lower surface of the swinging portion of the door 88 is a lint screen 96 secured to a depending frame 98 rigid with respect to the door 88. The lint screen 96 provides an inlet screen when the door 88 is in closed position so that lint or other material will not be pulled through the intake 41 and through the passageway 46. Access to the lint screen 96 is obtained by opening the door 88.

Figure 2:
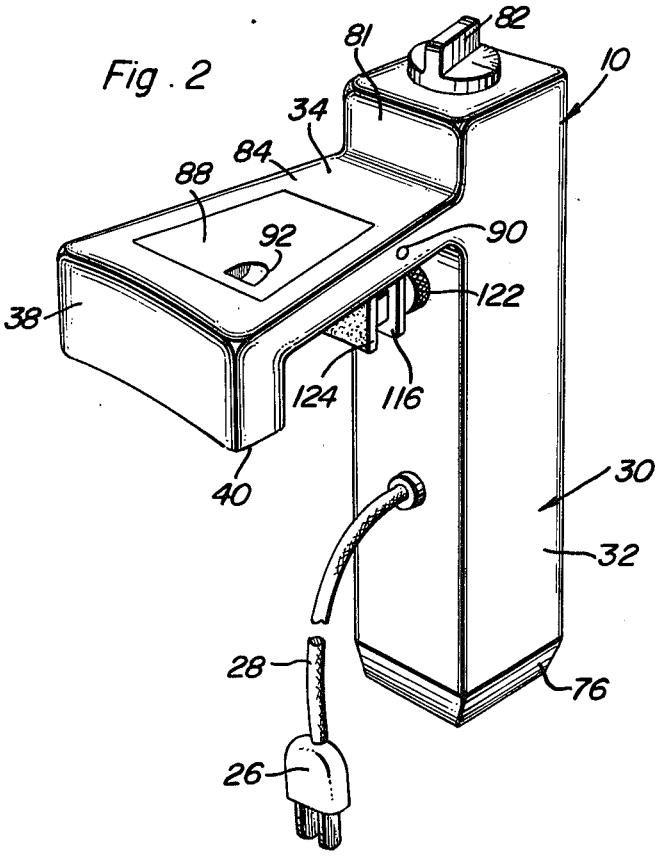
FIG. 2 is a perspective view of the ventilator.
Figure 5:
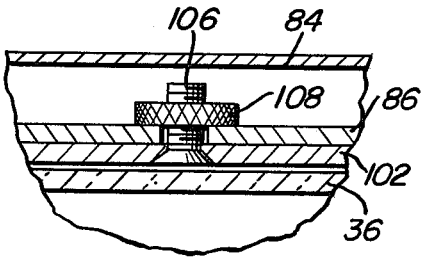
FIG. 5 is a fragmental, sectional view illustrating further structural details of the attachment between the clamp and housing for the ventilator.

A clamp assembly 100 of generally inverted U-shaped configuration as illustrated in FIG. 7 is employed to secure the ventilator 10 to the bowl 12 with the horizontally disposed web 102 of the clamp 100 underlying and engaging the bottom surface of the bottom wall 86 and the inner leg 104 disposed against the inner surface of the inner portion 38 of the housing 30 as illustrated in FIG. 2. The web 102 includes a threaded stud 106 fixedly secured thereto and which extends up through an opening in the bottom wall 86 of the intermediate portion 34 and is provided with a retaining nut 108 thereon which fixedly secures the clamp 100 to the intermediate portion 34 with the access door 88 providing access to the retaining nut 108 to enable assembly and disassembly of the clamp 100 in relation to the housing 30. To rigidify the clamp 100, the corner portions thereof are provided with ribs 110 which are received in corresponding recesses 112 in the bottom wall 86 and the juncture between the bottom wall 86 and the vertical inner wall 114 of the inner portion 38 of the housing 30.

The inner wall 114 is slightly arcuate to provide an inwardly facing convex surface as illustrated in FIG. 4 and the depending leg 104 of the clamp 100 is correspondingly curved to conform with the concavity of the inner surface of the top lip or rim 36 of the commode bowl 12. A cushioning material 115 is provided on the inner surface of the leg 104 of the clamp 100 to prevent scratching or marring of the commode bowl rim. The other leg of the clamp 100 designated by numeral 116 includes a clamp screw 118 threaded through a nut 120 rigid with leg 116 with the screw 118 including a knurled head 122 to facilitate rotation of the clamp screw 118. The inner end of the clamp screw 118 is provided with a clamp plate 124 having a layer of cushioning material 126 thereon to prevent the marring of the external surface of the commode bowl. The clamp plate 124 is also slightly curved to conform with the external curvature of the commode bowl rim 36.

The adjustment feature of the clamp structure enables the ventilator to be positioned on any size commode lip within the range of the clamp. The cushioning material may be in the form of an adhesive which will more or less permanently apply the ventilator to the commode. The adhesive may be of the contact type that is provided with a protective covering in the form of a panel of wax paper, or the like, which is retained in place until the device is to be installed at which time the covering is removed and the clamp manipulated in a manner to secure it to the commode bowl, after which the housing may be installed on the stud 106 and the nut 108 which may be in the form of a knurled nut then will be used to secure the housing in place.

In installing the device, spacer shims may be supplied for positioning on the hinge bolt and engaging the top surface of the commode to space the seat 128 slightly further above the rim 36 than is conventional and similar shims may be provided for positioning under the bumper spacer 130 normally provided at the forward end of the seat 128. This maintains the seat 128 in parallel relation and provides adequate space to enable the intermediate portion 34 of the housing to be positioned between the upper surface of the lip or rim 36 and the undersurface of the seat 128. The shims are designated by numeral 132 and may be in the form of plastic material or other material similar to that from which the bumper spacers 130 are manufactured. In most installations, shims are not necessary, but in some installations, the space between the seat and the commode bowl is relatively short.

If desired, an alternative switch structure may be provided, such as a conventional toggle switch, in lieu of the timer switch and an indicator lamp may be also provided to indicate that the device is in operation. The warning light would indicate that the system is operative and the use of a simple toggle switch and indicater light would be slightly less expensive but would not provide the automatic timer feature as provided by the timer switch.

The high temperature of the burning coil serves to neutralize, deodorize and purify the air and gases passing therethrough so that any odors entrained in the air and gases will be deodorized so that the air discharged into the bathroom will be substantially free of all objectionable odors. This eliminates the necessity of venting the interior of the commode to ambient air externally of the bathroom such as to the atmosphere or some other area remote from the bathroom.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A commode ventilator for attachment to the upper edge of a commode bowl comprising a housing having a vertically extending outer portion for disposition alongside of the exterior of the upper portion of a commode bowl and an inwardly extending intermediate portion to extend between the upper edge of the commode bowl and a seat on the commode and an inner portion having a terminal end for disposition interiorly of the commode bowl and having an opening therein defining an intake, fan means in said housing for intake of air and odors into the housing, heating means in said housing engaged by the air and odors for neutralizing and deodorizing the odors, said housing including a discharge opening at the lower end of the vertically disposed outer portion for discharging the deodorized air into the ambient air in the bathroom, clamp means secured to the intermediate portion of said housing and including an adjustment means for clamping the clamp means to the upper rim of a commode bowl, thereby anchoring the ventilator thereto, the inner portion of said housing being downturned, and terminating in an open lower end providing an intake for air and odors, said intermediate portion including a top wall having a pivital acess door therein providing access to the interior of the intermediate portion, a lint screen mounted on the access door and forming a screen for incoming air, said fan means including an axial flow fan and motor supported in the vertically disposed outer portion of said housing, said heating means including an electric resistance type heating wire formed into a coil disposed in the flow path of air and odors passing through the vertical outer portion of said housing, a screen in the discharge opening at the lower end of the vertical portion of said housing to prevent access to the heating means, a timer control for said fan means and heating means to operate the ventilator for a predetermined time period and automatically deenergize the ventilator at the end of such a period, said clamp means being in the form of a downwardly opening channel-shaped member having generally parallel vertical leg portions extending downwardly from a generally horizontal web, a screw threaded clamp screw extending through the outer leg portion and including a clamp plate for engagement with the outer surface of the upper rim of the commode bowl in opposition to engagement of the inner leg portion with the inner surface of the upper rim of the commode bowl, said web including an upstanding screw threaded stub extending through a bottom wall of the intermediate portion of the housing and including a retaining nut on the upper end thereof, said access door in the upper wall of the intermediate portion providing access to the retaining nut to enable assembly and disassembly of the clamp means therewith.

2. The structure as defined in claim 1, wherein the clamp plate and inner leg portion of the clamp means are curved to conform with the curvature of the engaged surfaces of the commode bowl rim, said web and leg portions of said clamp means including a reinforcing rib formed therein to strengthen and rigidify the clamp means.

* * * * *